US009293105B2

(12) United States Patent
Tsuda

(10) Patent No.: US 9,293,105 B2
(45) Date of Patent: Mar. 22, 2016

(54) LIQUID CRYSTAL DISPLAY DEVICE AND METHOD OF DRIVING THE SAME

(71) Applicant: Japan Display Inc., Minato-ku (JP)

(72) Inventor: Hiroki Tsuda, Tokyo (JP)

(73) Assignee: Japan Display Inc., Minato-ku (JP)

( * ) Notice: Subject to any disclaimer, the term of this patent is extended or adjusted under 35 U.S.C. 154(b) by 28 days.

(21) Appl. No.: 14/140,883

(22) Filed: Dec. 26, 2013

(65) Prior Publication Data

US 2014/0184661 A1 Jul. 3, 2014

(30) Foreign Application Priority Data

Dec. 27, 2012 (JP) ..... 2012-285627

(51) Int. Cl.
*G09G 5/10* (2006.01)
*G09G 3/36* (2006.01)

(52) U.S. Cl.
CPC ..... *G09G 3/3696* (2013.01); *G09G 3/3614* (2013.01); *G09G 2300/0434* (2013.01); *G09G 2320/0247* (2013.01); *G09G 2320/0257* (2013.01)

(58) Field of Classification Search
USPC ..... 345/690, 691, 694
See application file for complete search history.

(56) References Cited

U.S. PATENT DOCUMENTS

| | | | | |
|---|---|---|---|---|
| 2002/0126076 | A1* | 9/2002 | Itakura | 345/87 |
| 2009/0115712 | A1* | 5/2009 | Morimoto et al. | 345/87 |
| 2009/0153454 | A1* | 6/2009 | Irie et al. | 345/89 |
| 2011/0122114 | A1* | 5/2011 | Tanaka et al. | 345/211 |
| 2011/0234569 | A1* | 9/2011 | Ooishi et al. | 345/211 |
| 2013/0169899 | A1 | 7/2013 | Tsuda et al. | |
| 2014/0085348 | A1* | 3/2014 | Tsuda et al. | 345/690 |

FOREIGN PATENT DOCUMENTS

JP 2002-258813 9/2002

* cited by examiner

*Primary Examiner* — Jason Olson
*Assistant Examiner* — Deeprose Subedi
(74) *Attorney, Agent, or Firm* — Oblon, McClelland, Maier & Neustadt, L.L.P.

(57) ABSTRACT

A first substrate includes a first switching element arranged in a first color pixel and a second switching element arranged in a second color pixel of which color is different from the color of the first color pixel in an active area. A driving unit superimposes DC bias voltages on voltages corresponding to gradations to be displayed in the first color pixel and the second color pixel, and to supply the superimposed voltages to the first pixel electrode and the second pixel electrode, respectively. A first halftone gradation voltage obtained by superimposing a first DC bias voltage on a voltage corresponding to a halftone gradation is supplied to the first pixel electrode. A second halftone gradation voltage obtained by superimposing a second DC bias voltage different from the first DC bias voltage on a voltage corresponding to the halftone gradation is supplied to the second pixel electrode.

17 Claims, 6 Drawing Sheets

LIQUID CRYSTAL DISPLAY DEVICE AND METHOD OF DRIVING THE SAME

CROSS-REFERENCE TO RELATED APPLICATION

This application is based upon and claims the benefit of priority from prior Japanese Patent Application No. 2012-285627, filed Dec. 27, 2013, the entire contents of which are incorporated herein by reference.

FIELD

Embodiments described herein relate generally to a liquid crystal display device and a method of driving the same.

BACKGROUND

Liquid crystal display devices having features of light weight, thin thickness, low power consumption, etc, have been widely used as display devices for office automation (OA) apparatuses in various fields such as personal computers and television sets.

In recent years, the liquid crystal display devices are also used as display devices for portable terminal devices such as mobile phones, car navigation devices, game machines, etc.

In recent years, In-plane Switching (IPS) mode liquid crystal display panels or Fringe Field Switching (FFS) mode liquid crystal display panels have been put to practical use. The FFS mode or IPS mode liquid crystal display panel has a configuration in which a liquid crystal layer is held between an array substrate including pixel electrodes and a common electrode, and a counter substrate. Switching is performed by rotating liquid crystal molecules of the liquid crystal layer in a plane parallel to the substrate. The display modes have advantages of wide viewing angle, etc.

On the other hand, in liquid crystal display devices performing color display, a technique of performing normal gradation display by individually setting γ curves of RGB colors has been proposed.

BRIEF DESCRIPTION OF THE DRAWINGS

The accompanying drawings, which are incorporated in and constitute a portion of the specification, illustrate embodiments of the invention, and together with the general description given above and the detailed description of the embodiments given below, serve to explain the principles of the invention.

DETAILED DESCRIPTION

Figure 1:
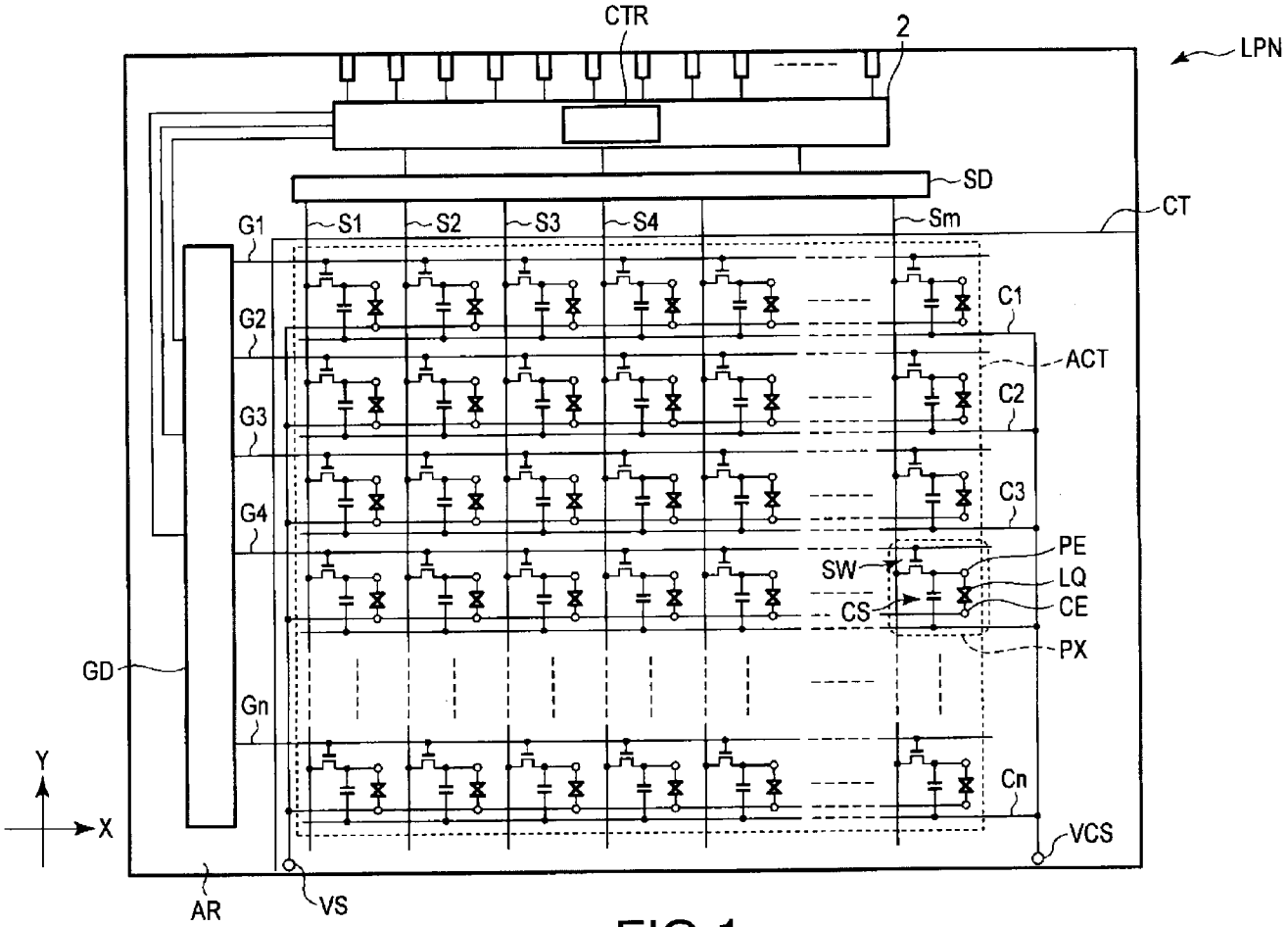
FIG. 1 is a figure schematically showing a structure and equivalent circuit of a liquid crystal display panel LPN forming a liquid crystal display device according to an embodiment.

A liquid crystal display device and a method of driving the same according to an exemplary embodiment of the present invention will now be described with reference to the accompanying drawings wherein the same or like reference numerals designate the same or corresponding portions throughout the several views.

According to one embodiment, a liquid crystal display device includes: a first substrate including a first switching element arranged in a first color pixel and a second switching element arranged in a second color pixel of which color is different from the color of the first color pixel in an active area, a common electrode arranged in the first color pixel and the second color pixel, an insulating film arranged on the common electrode, first and second pixel electrodes arranged on the insulating film in the first and second color pixels and electrically connected with the first and second switching elements, respectively, and a first alignment film covering the first pixel electrode and the second pixel electrode; a second substrate including a second alignment film facing the first alignment film; a liquid crystal layer held between the first alignment film and the second alignment film; and a driving unit to superimpose DC bias voltages on voltages corresponding to displayed gradations in the first color pixel and the second color pixel, and to supply the superimposed voltages to the first pixel electrode and the second pixel electrode, respectively; wherein a first halftone gradation voltage obtained by superimposing a first DC bias voltage on a voltage corresponding to a halftone gradation is supplied to the first pixel electrode, and wherein a second halftone gradation voltage obtained by superimposing a second DC bias voltage different from the first DC bias voltage on the voltage corresponding to the halftone gradation is supplied to the second pixel electrode.

According to other embodiment, a method of driving a liquid crystal display device including: a first substrate including a first switching element arranged in a first color pixel and a second switching element arranged in a second color pixel of which color is different from the color of the first color pixel in an active area, a common electrode arranged in the first color pixel and the second color pixel, an insulating film arranged on the common electrode, first and second pixel electrodes arranged on the insulating film in the first and second color pixels and electrically connected with the first and second switching elements, respectively, and a first alignment film covering the first pixel electrode and the second pixel electrode; a second substrate including a second alignment film facing the first alignment film; and a liquid crystal layer held between the first alignment film and the second alignment film; the method driving the liquid crystal display device comprising the steps: when superimposing DC bias voltages on voltages corresponding to gradations to be displayed in the first color pixel and the second color pixel, respectively, and to supply the superimposed voltages to the first pixel electrode and the second pixel electrode, supplying a first halftone gradation voltage obtained by superimposing a first DC bias voltage on a voltage corresponding to a halftone gradation to be displayed to the first pixel electrode; and supplying a second halftone gradation voltage obtained by superimposing a second DC bias different from the first DC bias voltage on a voltage corresponding to a halftone gradation to be displayed to the second pixel electrode.

FIG. 1 is a figure schematically showing a structure and equivalent circuit of a liquid crystal display panel LPN forming a liquid crystal display device according to an embodiment.

The liquid crystal display device is equipped with an active-matrix and transmissive type liquid crystal display panel LPN. The liquid crystal display panel LPN includes an array substrate AR as a first substrate, a counter substrate CT as a second substrate arranged so as to face the array substrate AR, and a liquid crystal layer LQ held therebetween. The liquid crystal display panel LPN is equip with an active area ACT which displays images. The active area ACT includes a plurality of pixels PX arranged in a m×n matrix shape (herein, "m" and "n" are positive integers).

The array substrate AR includes "n" gate lines G (G1-Gn) and n capacitance lines C (C1-Cn) extending in a first direction X, "m" source lines S (S1-Sm) extending in a second direction Y perpendicular to the first direction X, switching elements SW, each of which is electrically connected to the gate line G and the source line S in each pixel PX, pixel electrodes PE, each of which is electrically connected to the switching element SW in each pixel PX, and a common electrode CE facing the pixel electrodes PE, etc., in the active area ACT.

Each gate line G is pulled out to the outside of the active area ACT and electrically connected to a gate driver GD. Each source line S is pulled out to the outside of the active area ACT and electrically connected to a source driver SD. Each capacitance line C is pulled out to the outside of the active area ACT and electrically connected to a voltage applying unit VCS to which an auxiliary capacitance voltage is supplied. The common electrode CE is electrically connected to a power supply unit VS to which a common voltage (Vcom) is supplied. For example, at least a portion of the gate driver GD and the source driver SD is formed in the array substrate AR, and electrically connected to a driving IC chip 2. In this embodiment, the driving IC chip 2 includes a controller CTR which functions as a signal source required for driving the liquid crystal display panel LPN and controls the gate driver GD and the source driver SD. The controller CTR controls the common voltage supplied to the power supply unit VS, and also controls the auxiliary capacitance voltage supplied to the voltage supplying unit VCS. The driving IC chip 2 is mounted on the array substrate AR outside the active area ACT of the liquid crystal display panel LPN. The source driver SD (or the source driver SD and the controller CTR) functions as the driving unit which superimposes a DC bias voltage on a voltage corresponding to gradation which is to be displayed in the pixel PX and supplies to the pixel electrode PE.

The liquid crystal display panel LPN in this embodiment has a configuration which can be applied to the FFS mode or the IPS mode, and the array substrate AR includes the pixel electrodes PE and the common electrodes CE. In the liquid crystal display panel LPN having the above-described configuration, liquid crystal molecules forming the liquid crystal layer LQ are switched mainly using a lateral electric field (for example, an electric field substantially parallel to a principal plane of the substrate among fringe electric fields), generated between the pixel electrode PE and the common electrode CE.

Figure 2:
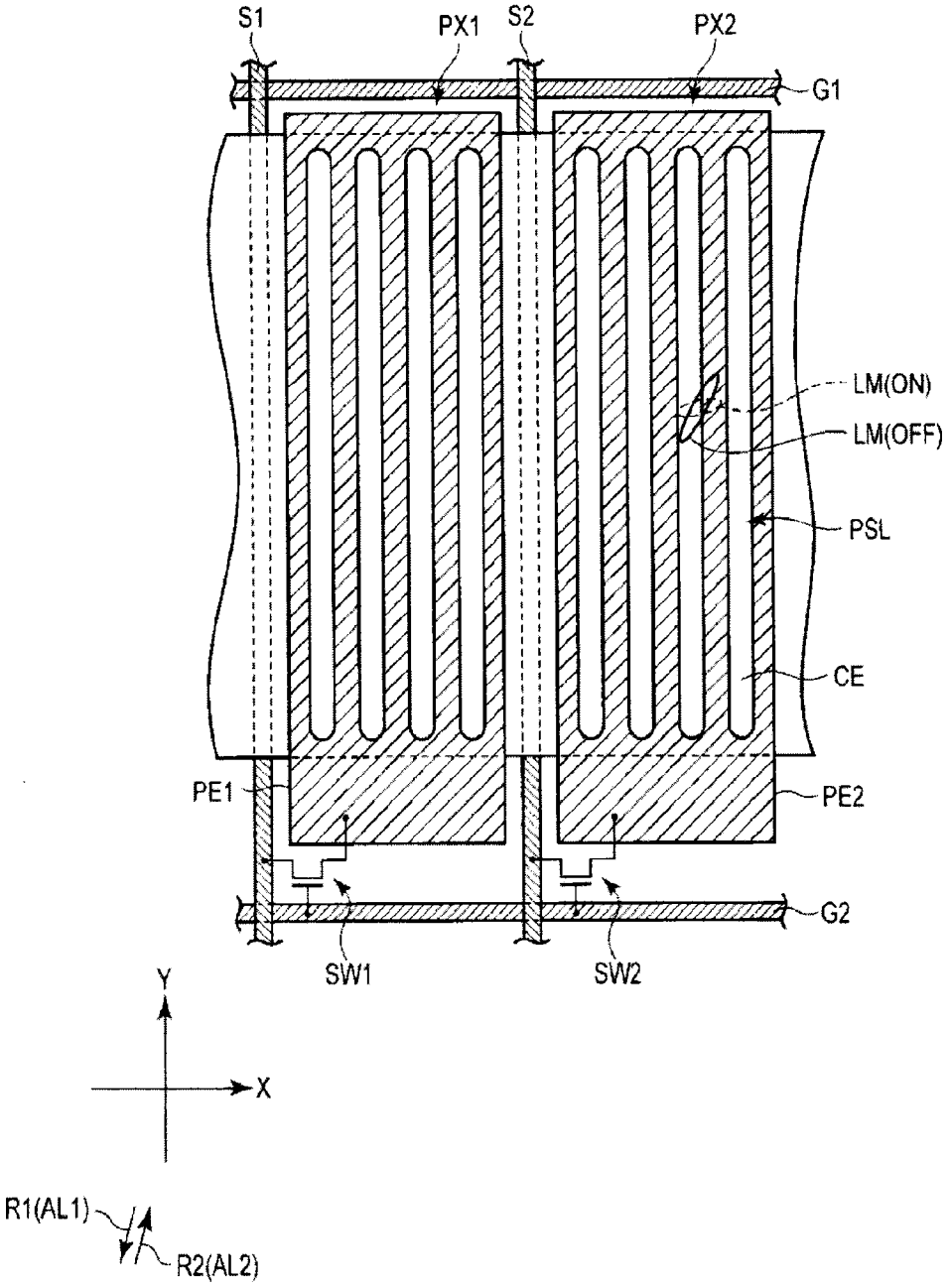
FIG. 2 is a plan figure schematically showing a structure of pixels PX formed on an array substrate AR illustrated in FIG. 1 as seen from a counter substrate (CT) side.

FIG. 2 is a plan view schematically showing a structure of pixels PX forming the array substrate AR shown in FIG. 1 as seen from a counter substrate (CT) side. Herein, only the main elements necessary for the explanation are illustrated. The pixels aligned in the first direction X are pixels of different colors. In the illustrated example, for example, the pixel PX1 is a green pixel, and the pixel PX2 is a red pixel or a blue pixel.

The gate lines G1 and G2 extend in the first direction X, respectively. The source lines S1 and S2 extend in the second direction Y. The common electrode CE extends in the first direction X. That is, the common electrode CE is arranged in the pixel PX1 and PX2 and commonly formed in a plurality of the pixels PX adjacent in the first direction X striding over the source lines S1 and S2. In addition, although not illustrated, the common electrode CE may be commonly formed in a plurality of the pixels adjacent in the second direction Y.

A switching element SW1 and a pixel electrode PE1 connected with the switching element SW1 are arranged in the pixel PX1. The switching element SW1 is electrically connected to the gate line G2 and the source line S1. A switching element SW2 and a pixel electrode PE2 connected with the switching element SW2 are arranged in the pixel PX2. The switching element SW2 is electrically connected to the gate line G2 and the source wire line S2.

The pixel electrodes PE1 and PE2 are located on the common electrode CE. Each of the pixel electrodes PE1 and PE2 is formed in an island shape corresponding to a rectangular pixel. In this embodiment, each of the pixel electrodes PE1 and PE2 is formed in a substantially rectangular shape in which the length thereof in the first direction X is shorter than the length in the second direction Y. A plurality of slits PSL facing the common electrode CE is formed in each of the pixel electrodes PE1 and PE2. In this embodiment, each of the slits PSL extends in the second direction Y and has a long axis parallel to the second direction Y.

Figure 3:
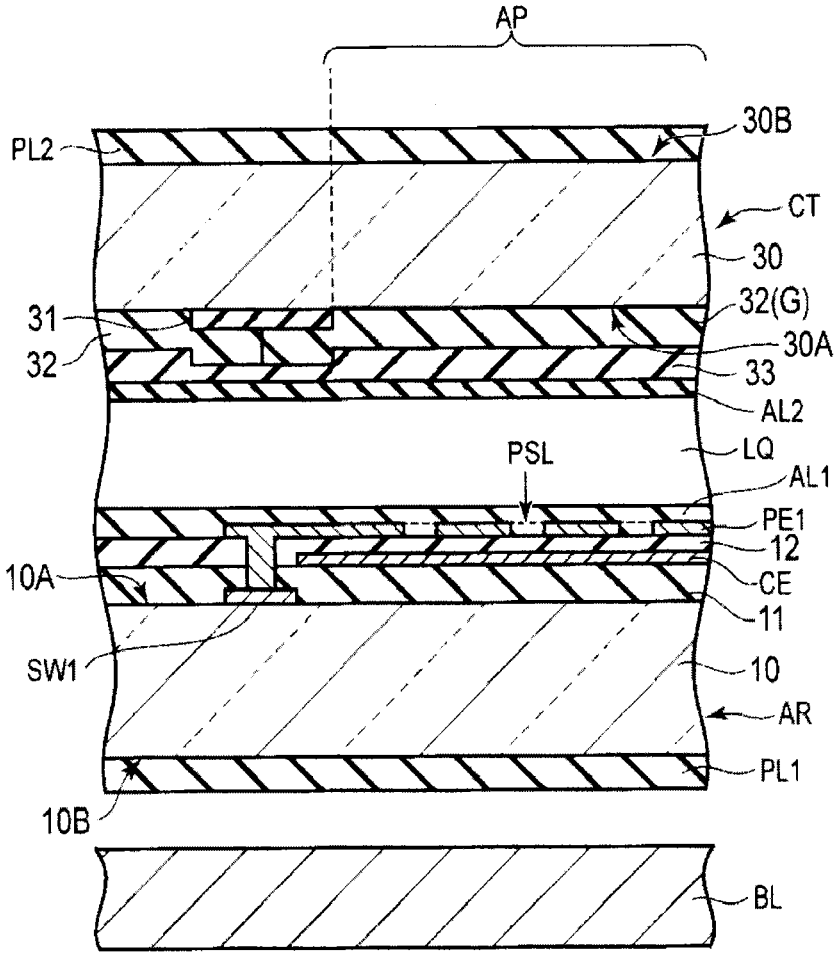
FIG. 3 is a figure showing a cross-sectional structure of the liquid crystal display panel LPN shown in FIG. 1.

FIG. 3 is a figure showing a cross-sectional structure of the liquid crystal display panel LPN shown in FIG. 1. Herein, a cross-sectional figure of the pixel PX1 is schematically illustrated.

The array substrate AR is formed using a first transparent insulating substrate 10 such as a glass substrate. The array substrate AR includes the switching element SW1, the common electrode CE, the pixel electrode PE1, a first alignment film AL1, etc., on the side thereof facing the counter substrate CT. The switching element SW1 is formed of, for example, a thin-film transistor (TFT). The switching element SW1 is covered with a first insulating film 11.

The common electrode CE is formed on the first insulating film 11. The common electrode CE is formed using a transparent conductive material, for example, Indium Tin Oxide (ITO), Indium Zinc Oxide (IZO), etc. The common electrode CE is covered with a second insulating film 12. In addition, the second insulating film 12 is also arranged on the first insulating film 11.

The pixel electrode PE1 is formed on the second insulating film 12 facing the common electrode CE. The pixel electrode PE1 is electrically connected with the switching element SW1 through a contact hole penetrating the first insulating film 11 and the second insulating film 12. In addition, in the pixel electrode PE1, the slit PSL is formed facing the common electrode CE through the second insulating film 12. The pixel electrode PE1 is formed using a transparent conductive material, for example, ITO, IZO, etc. The pixel electrode PE1 is covered with the first alignment film AL1. In addition, the first alignment film AL1 is also disposed on the second insulating film 12. The first alignment film AL1 is formed using a material having a horizontal alignment characteristics and arranged on the surface of the array substrate AR, which is in contact with the liquid crystal layer LQ.

The counter substrate CT is formed using a second transparent insulating substrate 30 such as a glass substrate. The counter substrate CT includes a black matrix 31 defining the pixels PX, a color filter 32, an overcoat layer 33, a second alignment film AL2, etc., on the side thereof facing the array substrate AR.

The black matrix 31 is formed in an inner surface 30A of the second insulating substrate 30 facing wiring portions such as the gate line G, the source line S and the switching element SW1 arranged in the array substrate AR, and forms an aperture AP facing the pixel electrode PE1. The color filters 32 are formed on the inner surface 30A of the second insulating substrate 30, and arranged in the apertures AP. In addition, the color filters 32 also extend on the black matrix 31. The color filters 32 are formed using resin materials colored in, for example, red, blue, and green. The boundary between the different color filters 32 is located on the black matrix 31. The color filter 32 arranged in the pixel PX1 illustrated in the figure is the green color filter.

The color filter 32 is covered with the overcoat layer 33. The overcoat layer 33 planarizes unevenness of the surface of the black matrix 31 and the color filter 32. The overcoat layer 33 is formed using, for example, a transparent resin material. The overcoat layer 33 is covered with the second alignment film AL2. The second alignment film AL2 is formed using a material having a horizontal alignment characteristics and arranged on the surface of the counter substrate CT, which is in contact with the liquid crystal layer LQ.

The array substrate AR and the counter substrate CT described above are arranged so that the first alignment film AM and the second alignment film AL2 face each other. A predetermined cell gap is formed between the array substrate AR and the counter substrate CT by pillar-shaped spacers formed on one of the two substrates. The array substrate AR and the counter substrate CT are attached while the cell gap is formed. The liquid crystal layer LQ is formed with a liquid crystal material including liquid crystal molecules LM and sealed in the cell gap formed between the first alignment film AL1 of the array substrate AR and the second alignment film AL2 of the counter substrate CT. The liquid crystal layer LQ is formed with, for example, a liquid crystal material having positive dielectric anisotropy. In addition, the liquid crystal layer LQ may be formed with a liquid crystal material having negative dielectric anisotropy.

A backlight BL is arranged on the back side of the array substrate AR which forms the liquid crystal display panel LPN in the illustrated example. Various types of backlights BL can be used. For example, a light emitting diode (LED) or a cold cathode fluorescent lamp (CCFL), etc., can be applied as a light source of the backlight BL, and the explanation approximately its detailed structure is omitted.

A first polarization plate PL1 having a first absorption axis is arranged on an outer surface of the array substrate AR, i.e., an outer surface 10B of the first insulating substrate 10. In addition, a second polarization plate PL2 having a second absorption axis in a positional relationship of Cross Nicols with respect to the first absorption axis is arranged on an outer surface of the counter substrate CT, i.e., an outer surface 30B of the second insulating substrate 30. In addition, other optical elements such as a retardation film may be disposed between the first insulating substrate 10 and the first polarization plate PL1 or between the second insulating substrate 30 and the second polarization plate PL2.

As shown in FIG. 2, alignment treatment (for example, rubbing treatment or light alignment treatment) is performed on the first alignment film AL1 and the second alignment film AL2 in a plane parallel to a principal surface of the substrate (or the X-Y plane) so as to have parallel orientations, each other. With respect to the first alignment film AL1, the alignment treatment is performed in a direction intersecting the long axis of the slit PSL (second direction Y in the example illustrated in FIG. 2) with an acute angle of 45° or less. The alignment treatment direction R1 of the first alignment film AL1 is, for example, a direction intersecting the second direction Y with an angle of 5° to 15°. In addition, with respect to the second alignment film AL2, the alignment treatment is performed in the direction parallel to the alignment treatment direction R1 of the first alignment film AL1. The alignment treatment direction R1 of the first alignment film AL1 and the alignment treatment direction R2 of the second alignment layer AL2 are opposite to each other.

In the liquid crystal display device according to this embodiment, the liquid crystal molecules LM in the liquid crystal display panel LPN are aligned in an initial alignment direction (for example, alignment direction R1) regulated by the first alignment film AM and the second alignment film AL2 in the state where no electric field is generated between the pixel electrode PE and the common electrode CE. One of the first absorption axis of the first polarization plate PL1 and the second absorption axis of the second polarization plate PL2 is parallel to the initial alignment direction of the liquid crystal molecules LM, and the other is perpendicular to the initial alignment direction.

Hereinafter, operations of the liquid crystal display device having the above structure are described.

At the time OFF, i.e., when no voltage is applied so that potential difference occurs between the pixel electrode PE and the common electrode CE, no electric field is generated between the pixel electrode PE and the common electrode CE. As shown by a solid line in FIG. 2, the liquid crystal molecules LM contained in the liquid crystal layer LQ are aligned in the initial alignment direction intersecting the second direction Y with an acute angle in the X-Y plane.

At the time OFF, a portion of light emitted from the backlight BL passes through the first polarization plate PL1, and is incident to the liquid crystal display panel LPN. The light incident to the liquid crystal display panel LPN is linearly polarized light perpendicular to the first absorption axis of the first polarization plate PL1. The polarization state of the linearly polarized light is hardly changed when the light passes through the liquid crystal display panel LPN at the time OFF. Therefore, most of the linearly polarized light passing through the liquid crystal display panel LPN is absorbed by the second polarizing plate PL2 (black display).

On the other hand, at the time ON, i.e., when a voltage is applied to the liquid crystal layer LQ, a potential difference occurs between the pixel electrode PE and the common electrode CE, and a fringe electric field is generated between the pixel electrode PE and the common electrode CE. Therefore, as shown by a broken line in FIG. 2, the liquid crystal molecules LM are aligned in the direction different from the initial alignment direction in the X-Y plane. In the case of a positive type liquid crystal material, the liquid crystal molecules LM rotate so as to be aligned in the direction substantially parallel to the electric field in the X-Y plane. At this time, the liquid crystal molecules LM are aligned in the direction according to the intensity of the electric field.

At the time ON, the linearly polarized light perpendicular to the first absorption axis of the first polarization plate PL1 is incident to the liquid crystal display panel LPN, and the polarization state is changed according to the alignment state of the liquid crystal molecules LM when the light passes through the liquid crystal layer LQ. Therefore, at the time ON, at least a portion of the light passing through the liquid crystal layer LQ passes the second polarization plate PL2 (white display).

By the structure described above, the normally black mode is performed.

Next, a burn-in phenomenon of the liquid crystal display device in the FFS mode is described in brief.

A voltage for displaying a white-black checkered pattern is applied to the liquid crystal display panel LPN so that the checkered pattern is displayed on the entire surface of the active area ACT for a predetermined time. For example, in the liquid crystal display device displaying images with 256 gradations, a black display (gradation value G0) where no potential difference occurs between the pixel electrode PE and the common electrode CE is performed for the pixels PX in the first region of the active area ACT, and a white display where a potential difference corresponding to the white display (gradation value G255) occurs between the pixel electrode PE and the common electrode CE is performed for the pixels PX in the second region adjacent to the first region in the active area ACT.

Next, a voltage for displaying a halftone gradation (for example, gradation value G127) is applied to the liquid crystal display panel LPN so that an image having a uniform gray color gradation is displayed on the entire surface of the active area ACT. That is, in both of the pixels PX in the first region and the pixels PX in the second region, a potential difference corresponding to the same gray color gradation display occurs between the pixel electrode PE and the common electrode CE. In this case, in the first region, luminance almost equal to the luminance corresponding to the original halftone gradation can be obtained. However, in the second region, if the luminance becomes higher than the luminance corresponding to the original gray color gradation, a difference in the luminance occurs between the first region and the second region. Therefore, the checkered pattern is recognized as persistence of vision. This phenomenon is the burn-in phenomenon.

In this embodiment, the burn-in phenomenon is reduced by not only applying a voltage corresponding to the displayed gradation to the pixel electrode PE but also by superimposing a DC bias voltage on a voltage corresponding to each gradation as needed. In this regard, the case is explained, in which the driving is performed by inverting positive and negative polarities of the voltage supplied to the pixel electrode PE for each one frame. A voltage V0 according to the displayed gradation with respect to a common electrode voltage Vcom is set in advance, and a rectangular wave voltage of Vcom±V0 is applied to the pixel electrode PE as a pixel electrode voltage Vd. Herein, the applying of a DC bias voltage Vb to a voltage V0 according to a specific gradation corresponds to superimpose the DC bias voltage Vb on the rectangular wave voltage (Vcom±V0) to obtain (Vcom±V0+Vb). In this case, the rectangular wave voltage (Vcom±V0+Vb) is asymmetric with respect to the common electrode voltage Vcom in terms of positive and negative polarities. For example, in the case in which the DC bias voltage Vb has a positive polarity, a potential difference of (V0+Vb) occurs with respect to the common electrode voltage Vcom at the timing when the rectangular wave voltage has a positive polarity, and a potential difference of (V0−Vb) occurs with respect to the common electrode voltage Vcom at the timing when the rectangular wave voltage has a negative polarity. The inventors found that stress to the liquid crystal layer LQ can be reduced by applying asymmetric rectangular wave voltages having positive and negative polarities to the pixel electrode PE, and that the burn-in phenomenon can be reduced.

That is, the inventors verified that, in a first configuration example where no DC bias is applied in any gradation, there is a large difference between the luminance when a voltage for displaying the gray color gradation (for example, gradation value G127) is applied after black burn-in in the first region (after black in the checkered pattern is displayed for a predetermined time) and the luminance when a voltage for displaying the same gray color gradation as that of the first region is applied after white burn-in in the second region (after white in the checkered pattern is displayed for a predetermined time), and that the burn-in phenomenon is consequently viewed.

On the other hand, the inventors verified that, in a second configuration example where compensation is performed by applying a DC bias voltage to a voltage according to the gradation (G255) corresponding to the white display, the difference between the luminance after the black burn-in in the first region and the luminance after the white burn-in in the second region is smaller than that of the first configuration example, and that the burn-in phenomenon is reduced.

In addition, the inventors verified that, in a third configuration example where the compensation is performed by superimposing a DC bias voltage not only to the voltage according to the gradation (G255) corresponding to white display and but to a voltage according to a halftone gradation (for example, G31 and G63), the difference between the luminance after the black burn-in in the first region and the luminance after the white burn-in in the second region is much smaller than that of the second configuration example, and that the burn-in phenomenon can be further reduced.

Next, the flicker in the liquid crystal display device in the FFS mode is described.

The flicker is measured using a flicker meter, a display multimeter, etc., while a stripe-shaped flicker pattern is displayed in the active area ACT. The flicker pattern is formed by, for example, alternately arranging a stripe pattern of a gray color gradation display (for example, gradation value G127) and a stripe pattern of a white display (gradation value G255).

According to the inventor's analysis, it is verified that, although the burn-in phenomenon is reduced by performing the compensation by superimposing a DC bias voltage on a voltage according to a displayed gradation, the reduction of the burn-in phenomenon is not resulted with the reduction of the flicker at the same time in the display corresponding to some gradations. Particularly, in a normally black mode liquid crystal display device, when a potential difference (|Vd−Vcom|) between the voltage Vcom of the common electrode CE and the voltage Vd of the pixel electrode PE is 0, luminance (or transmissivity) becomes approximately 0 (that is, black display). The luminance increases as the potential difference (|Vd−Vcom|) increases. The characteristic is illustrated in a T-V characteristic curve representing a relationship between a voltage applied to the liquid crystal layer and the luminance. The T-V characteristic curve illustrates that, when a voltage corresponding to a portion in the halftone gradation range including a specific halftone gradation is applied, the luminance sharply changes (i.e., a slope of the curve becomes steep). Namely, in the case in which the driving is performed by inverting polarities of the voltage supplied to the pixel electrode PE, the compensation is performed by superimposing a DC bias voltage in some halftone gradation range. This means that an asymmetric rectangular wave voltage is applied to the pixel electrode PE in terms of positive and negative polarities. Therefore, since a difference in luminance between the case of the positive polarity and the case of the negative polarity is increased, the flicker is easily viewed.

According to the inventors' verification, though the flicker of approximately 2% is measured for the halftone gradation (for example, the gradation value G127) where the compensation by superimposing a DC bias voltage is not performed, the flicker of approximately 15% is measured for the gray color gradation (for example, the gradation value G63) where the compensation by superimposing a DC bias voltage of −100 mV is applied.

Therefore, it is preferable that the compensation by superimposing a DC bias voltage is not performed in order to suppress the flicker. Namely, in the example using normally black mode, the driving unit which superimposes a DC bias voltage on a voltage corresponding to a displayed gradation in the pixel PX and supplies the voltage to the pixel electrode PE sets the DC bias voltage to 0 V in a specific gradation range in which the flicker is easily viewed. More preferably, the driving unit performs the compensation by superimposing the DC bias on a voltage according to a displayed gradation in a specific gradation range in which the burn-in phenomenon easily occurs, while setting the DC bias voltage to 0 V in a specific gradation range in which the flicker is easily viewed. Particularly, in order to reduce the burn-in phenomenon, it is preferable that a DC bias voltage higher than that for the black display state in which no potential difference occurs between the pixel electrode PE and the common electrode CE is superimposed for the white display state in which a potential difference occurs between the pixel electrode PE and the common electrode CE. Thereby, it is possible to improve display quality.

Hereinafter, a first embodiment is described.

Figure 4A:
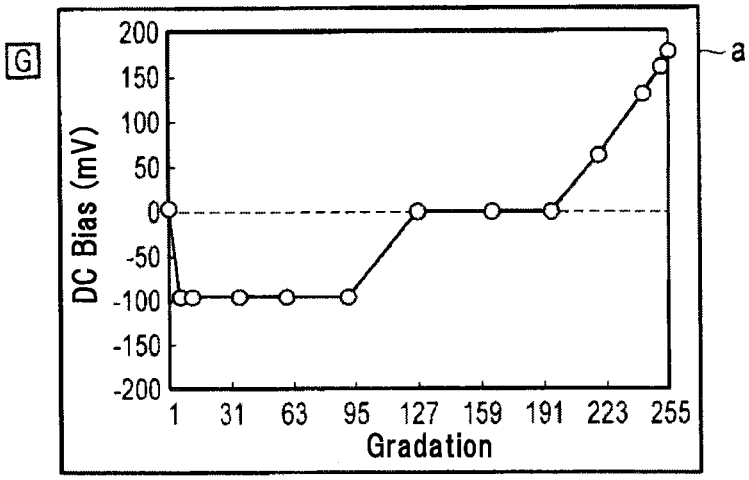
FIGS. 4A and 4B are figures showing a relationship between a gradation value of each color pixel and a DC bias voltage in a first embodiment.
Figure 4B:
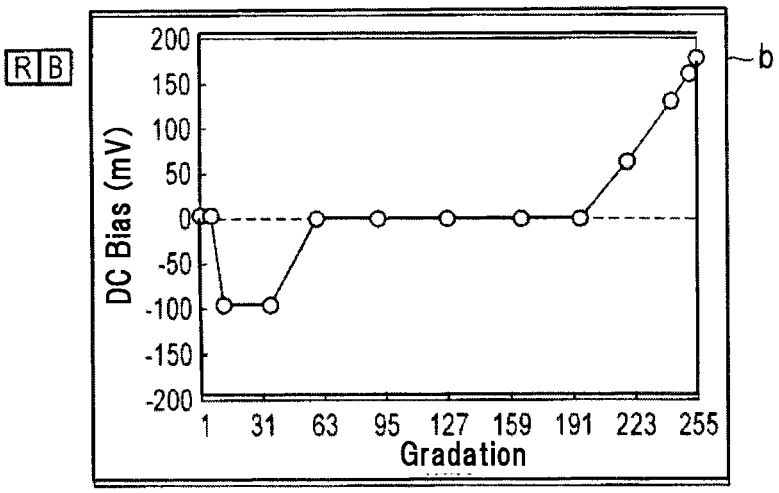

FIGS. 4A and 4B show a relationship between the gradation value of each color pixel and the DC bias voltage in a first embodiment.

In FIGS. 4A and 4B, the horizontal axis indicates the gradation value, and the vertical axis indicates a magnitude (mV) of the DC bias voltage corresponding to each gradation value. The relationship between the gradation value and the DC bias voltage shown in FIG. 4A is applied to, for example, the pixel electrode of the green pixel (G). The relationship between the gradation value and the DC bias voltage shown in FIG. 4B is applied to, for example, the pixel electrodes of the blue pixel (B) and the red pixel (R).

In FIG. 4A, the DC bias voltage for the gradation value G0 (corresponding to the black display state) is set to 0 mV, the DC bias voltage for a range from a gradation value larger than the gradation value G0 to a gradation value near the halftone gradation value G127 is set to a DC bias voltage having a negative polarity, the DC bias voltage for a range from a gradation value near the gradation value G127 to a gradation value near the gradation value G191 is set to 0 mV, the DC bias voltage having a positive polarity gradually increases according to an increase in gradation value over a range from a gradation value near the gradation value G191 to the maximum gradation value G255 (corresponding to the white display state), and the DC bias voltage for the gradation value G255 is set to the maximum DC bias voltage. In this embodiment, the DC bias voltage for the low gradation value such as the gradation value G31 and the gradation value G63 is set to approximately −100 mV, and the maximum DC bias voltage is set to approximately 180 mV. However, the set values of the DC bias voltage may be changed according to the performance of the driving unit.

In FIG. 4B, the DC bias voltage for a gradation value near the gradation value G0 (corresponding to the black display state) is set to 0 mV, the DC bias voltage for a range from a gradation value larger than the gradation value G0 to a gradation value near the halftone gradation value G63 is set to a DC bias voltage having a negative polarity, the DC bias voltage for a range from a gradation value near the gradation value G63 to a gradation value near the gradation value G191 is set to 0 mV, the DC bias voltage having a positive polarity gradually increases according to an increase in the gradation value over the gradation range from a gradation value near the gradation value G191 to the maximum gradation value G255 (corresponding to the white display state), and the DC bias voltage for the gradation value G255 is set to the maximum DC bias voltage. In this embodiment, the DC bias voltage for the halftone gradation value such as the gradation value G31 is set to approximately −100 mV, and the maximum DC bias voltage is set to approximately 180 mV. However, the set values of the DC bias voltage may be changed according to the performance of the driving unit.

FIGS. 4A and 4B are very different from each other in that, in the T-V characteristic curve, the DC bias voltage for the halftone gradation in the range (particularly, the range from the gradation value G63 to the gradation value G127) representing a sharp change in luminance is set to a DC bias voltage having a negative polarity in FIG. 4A, while being set to 0 mV in FIG. 4B.

That is, the driving unit supplies a first halftone gradation voltage obtained by superimposing the first DC bias voltage on a voltage corresponding to a specific halftone gradation to the pixel electrode of the green pixel (G). In addition, the driving unit supplies a second halftone gradation voltage obtained by superimposing the second DC bias voltage different from the first DC bias voltage on a voltage corresponding to a specific halftone gradation to the pixel electrodes of the blue pixel (B) and the red pixel (R). In this embodiment shown in FIGS. 4A and 4B, the first DC bias voltage is −100 mV, and the second DC bias voltage is 0 mV.

The green pixel has higher transmissivity and relative visibility in comparison with the blue pixel or the red pixel. Therefore, in the case in which the burn-in phenomenon occurs, the influence of the green pixel is dominated in comparison with the blue pixel or the red pixel, and the burn-in phenomenon is easily viewed. Accordingly, in the green pixel, the compensation by superimposing a DC bias voltage on a voltage corresponding to a gradation is performed in a gradation range according to the halftone gradation as well as a high gradation side including the gradation value corresponding to the white display or a low gradation side near the black display.

With respect to the blue pixel or the red pixel, in order to suppress the burn-in phenomenon, the compensation by superimposing a DC bias on a voltage according to a gradation is performed on a high gradation side including the gradation value corresponding to the white display and a low gradation side near the black display. On the other hand, the DC bias voltage for the halftone gradation range is set to 0 mV. Thereby the flicker is suppressed.

Figure 5:
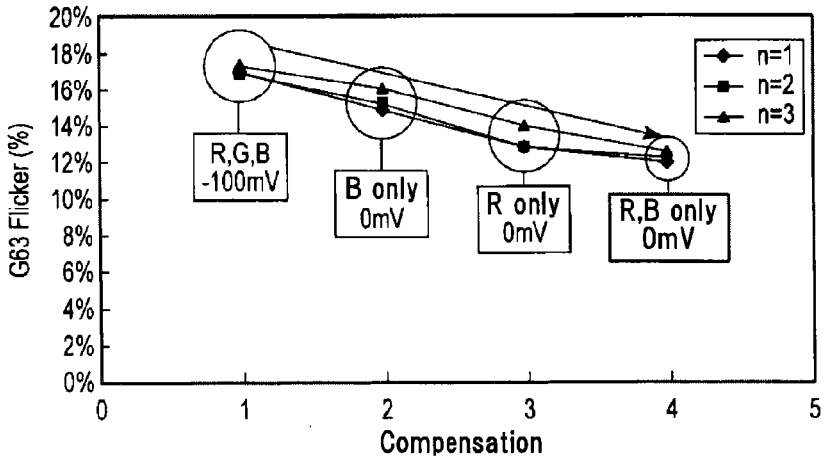
FIG. 5 is a figure showing an effect of flicker improvement in the first embodiment.

FIG. 5 is a figure showing an effect of flicker improvement in the first embodiment. Herein, the vertical axis denotes a flicker value (%) measured by the above-described method when the flicker pattern of a specific halftone gradation (gradation value G63) is displayed. In the figure, the red pixel is indicated by R, the green pixel is indicated by G, and the blue pixel is indicated by B.

As illustrated, in the case in which the DC bias voltages for the red pixel, the green pixel, and the blue pixel are set to −100 mV, respectively, the flicker value is approximately 17%. In the case in which the DC bias voltage for only the blue pixel is set to 0 mV (DC bias voltages for the red pixel and the green pixel are set to −100 mV), the flicker value is in a range of approximately 15 to 16%. In the case in which the DC bias voltage for only the red pixel is set to 0 mV (DC bias voltages for the blue pixel and the green pixel are set to −100 mV), the flicker value is in a range of approximately 13 to 14%. In the case in which the DC bias voltages for the blue pixel and the red pixel are set to 0 mV (DC bias voltage for the green pixel is set to −100 mV), the flicker value is approximately 12%.

It is verified that the flicker can be suppressed by not superimposing the DC bias voltage on a voltage corresponding to a specific halftone gradation (DC bias is set to 0 mV), in at least one of the red pixel and the blue pixel.

Next, a second embodiment is described.

Figure 6A:
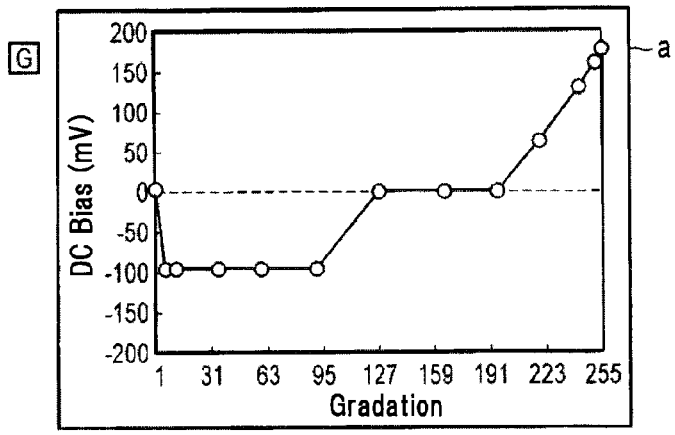
FIGS. 6A and 6B are figures showing a relationship between a gradation value of each color pixel and a DC bias voltage in a second embodiment.
Figure 6B:
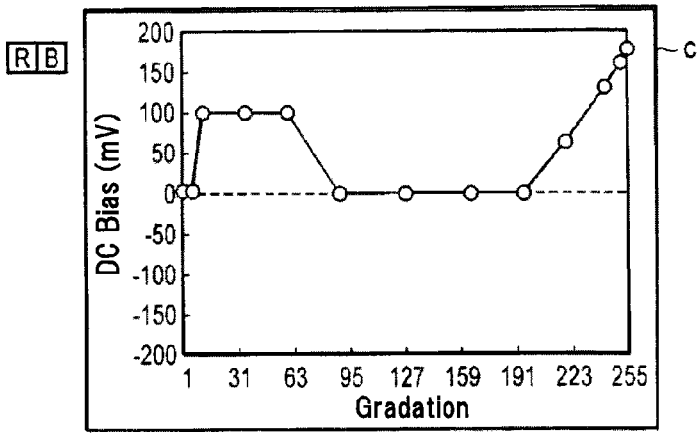

FIGS. 6A and 6B are figures showing a relationship between a gradation value of each color pixel and the DC bias voltage in a second embodiment.

The second embodiment is different from the first embodiment in that the DC bias voltages for the pixel electrodes of the blue pixel (B) and the red pixel (R) are different from those in the first embodiment. As well as the first embodiment, the relationship between the gradation value and the DC bias voltage shown in FIG. 6A is applied to the pixel electrode of the green pixel (G), and the detailed description thereof is omitted. The relationship between the gradation value and the DC bias voltage shown in FIG. 6B is applied to the pixel electrodes of the blue pixel (B) and the red pixel (R).

In FIG. 6B, the DC bias voltage for gradation values near the gradation value G0 (corresponding to the black display) is set to 0 mV, the DC bias voltage for a range from gradation value larger than the gradation value G0 to a gradation value near the halftone gradation value G95 is set to a DC bias voltage having a positive polarity, the DC bias voltage for a range from a gradation value near the gradation value G95 to a gradation value near the gradation value G191 is set to 0 mV, the DC bias voltage having a positive polarity gradually increases according to an increase in gradation value over a range from a gradation value near the gradation value G191 to the maximum gradation value G255 (corresponding to the white display state), and the DC bias voltage for the gradation value G255 is set to the maximum DC bias. In this embodiment, the DC bias voltage for the halftone gradation value such as the gradation value G63 is set to approximately +100 mV, and the maximum DC bias is set to approximately 180 mV. However, the set values of the DC bias may be changed according to the performance of the driving unit.

FIGS. 6A and 6B are very different from each other in that the DC bias voltage for the halftone gradation in a range (particularly, near the gradation value G63) representing a sharp change in luminance in the T-V characteristic curve, is set to a DC bias voltage having a negative polarity in FIG. 6A, and set to a DC bias voltage having the opposite polarity, i.e., a positive polarity in FIG. 6B.

That is, the driving unit supplies a first halftone gradation voltage obtained by superimposing the first DC bias voltage having a negative polarity on a voltage according to a specific halftone gradation to the pixel electrode of the green pixel (G). In addition, the driving unit supplies a second halftone gradation voltage obtained by superimposing the second DC bias voltage having a positive polarity on a voltage corresponding to a specific halftone gradation to the pixel electrodes of the blue pixel (B) and the red pixel (R). In the embodiment shown in FIGS. 6A and 6B, the first DC bias voltage is −100 mV, and the second DC bias voltage is +100 mV. The third DC bias is a DC bias voltage increasing according to an increase in gradation value on a high gradation side including the white display state.

Figure 7:
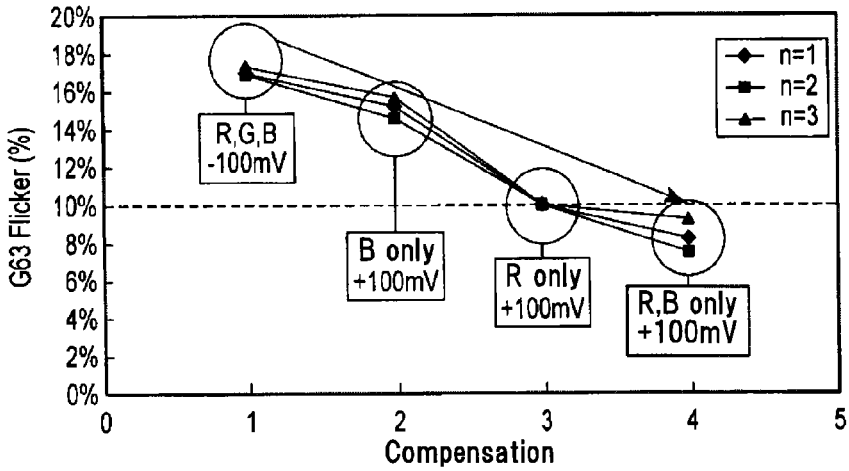
FIG. 7 is a figure showing an effect of flicker improvement in the second embodiment.

FIG. 7 is a figure showing an effect of flicker improvement in the second embodiment. Here, the vertical axis denotes a flicker value (%) measured by the above-described method when the flicker pattern of a specific halftone gradation (gradation value G63) is displayed. In the figure, the red pixel is indicated by R, the green pixel is indicated by G, and the blue pixel is indicated by B.

As illustrated, in the case in which the DC bias voltages for the red pixel, the green pixel, and the blue pixel are set to 100 mV, the flicker value is approximately 17%.

In the case in which the DC bias voltage for only the blue pixel is set to +100 mV (DC bias voltages for the red pixel and the green pixel are set to −100 mV), the flicker value is approximately 15%. In the case in which the DC bias voltage for only the red pixel is set to +100 mV (DC bias voltages for the blue pixel and the green pixel are set to −100 mV), the flicker value is approximately 10%. In the case in which the DC bias voltages for the blue pixel and the red pixel are set to +100 mV (DC bias for the green pixel is set to 100 mV), the flicker value is less than 10% (approximately 7 to 9%).

It is verified that the flicker can be suppressed by superimposing a DC bias voltage having a polarity opposite to that of the green pixel on a voltage corresponding to a specific halftone gradation in at least one of the red pixel and the blue pixel.

Figure 8:
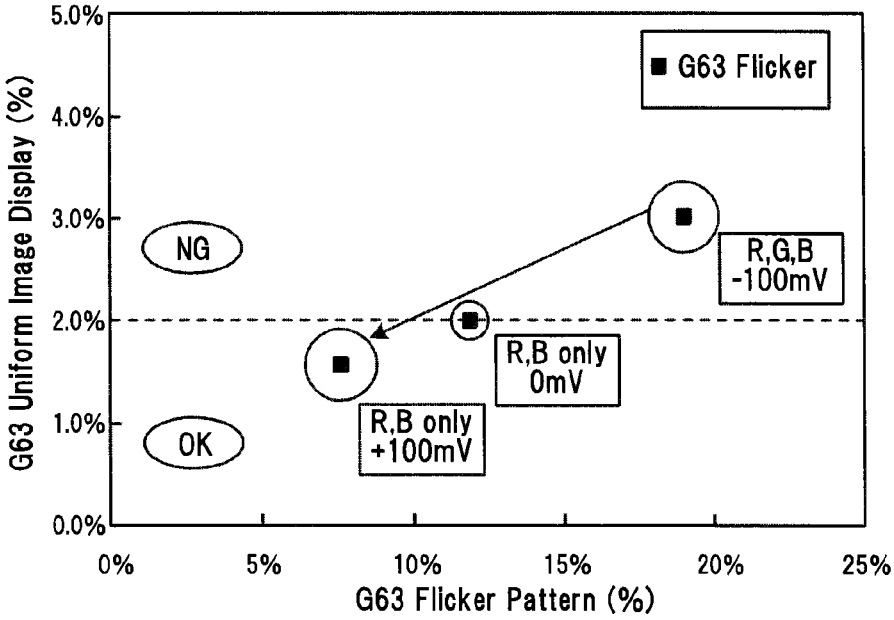
FIG. 8 is a figure showing a relationship between a flicker value measured when a flicker pattern is displayed and a flicker value measured when a uniform image is displayed.

FIG. 8 is a figure showing a relationship between a flicker value measured when a flicker pattern is displayed and a flicker value measured when a uniform image is displayed.

In FIG. 8, the horizontal axis denotes a flicker value (%) measured by the above-described method when a flicker pattern of a specific halftone gradation (gradation value G63) is displayed, and the vertical axis denotes a flicker value (%) measured by the above-described method when a uniform pattern of the specific halftone gradation (gradation value G63) is displayed. In addition, herein, as the flicker value which is allowable in the actual level, the flicker value corresponding to −30 dB, i.e., the flicker value of 2% or less is set as the allowable range according to the standard defined by Japanese Electronics and Information Technology Industries Association (JEITA).

In the halftone gradation display of the gradation value G63, in the case in which the DC bias voltages for the red pixel, the green pixel, and the blue pixel are set to −100 mV, respectively, the flicker value is approximately 3% when the uniform pattern is displayed.

On the other hand, in the first embodiment, in the case in which the DC bias voltages for the blue pixel and the red pixel are set to 0 mV (DC bias voltage for the green pixel is set to −100 mV), the flicker value is approximately 2% when the uniform pattern is displayed. In addition, in the second embodiment, in the case in which the DC bias voltages for the blue pixel and the red pixel are set to +100 mV (DC bias voltage for the green pixel is set to −100 mV), the flicker value is 1.5% when the uniform pattern is displayed. In this manner, it was verified that the flicker value can be maintained within the allowable range in the actual use level according to the first and second embodiments.

As described above, according to the embodiments, it is possible to provide a liquid crystal display device and a method of driving the same capable of improving display quality.

In addition, in the above-described embodiments, the slit PSL of the pixel electrode PE is formed so that the long axis thereof is parallel to the second direction Y. However, the slit PSL of the pixel electrode PE may be formed so that the long axis thereof is parallel to the first direction X or so that the long axis thereof is parallel to the direction intersecting the first direction X and the second direction Y. Further, the slit may also be formed to have a dog-legged shape.

While certain embodiments have been described, these embodiments have been presented by way of embodiment only, and are not intended to limit the scope of the inventions. In practice, the structural elements can be modified without departing from the spirit of the invention. Various embodiments can be made by properly combining the structural elements disclosed in the embodiments. For embodiment, some structural elements may be omitted from all the structural elements disclosed in the embodiments. Furthermore, the structural elements in different embodiments may properly be combined. The accompanying claims and their equivalents are intended to cover such forms or modifications as would fall within the scope and spirit of the inventions.

What is claimed is:

1. A liquid crystal display device, comprising:

a first substrate including a first switching element arranged in a first color pixel and a second switching element arranged in a second color pixel of which color is different from the color of the first color pixel in an active area, a common electrode arranged in the first color pixel and the second color pixel, an insulating film arranged on the common electrode, first and second pixel electrodes arranged on the insulating film in the first and second color pixels and electrically connected with the first and second switching elements, respectively, and a first alignment film covering the first pixel electrode and the second pixel electrode;

a second substrate including a second alignment film facing the first alignment film;

a liquid crystal layer held between the first alignment film and the second alignment film; and a driving unit to superimpose DC bias voltages on voltages corresponding to gradations to be displayed in the first color pixel and the second color pixel, and to supply the superimposed voltages to the first pixel electrode and the second pixel electrode, respectively;

wherein a first halftone gradation voltage obtained by superimposing a first DC bias voltage on a voltage corresponding to a halftone gradation to be displayed is supplied to the first pixel electrode, wherein a second halftone gradation voltage obtained by superimposing a second DC bias voltage different from the first DC bias voltage on a voltage corresponding to a halftone gradation to be displayed is supplied to the second pixel electrode, and wherein the first and second half tone gradation voltages supplied to the first and second pixel electrodes are respectively formed of asymmetric rectangular wave voltages with respect to positive and negative polarities.

2. The liquid crystal display device according to claim 1, wherein the first DC bias voltage has a negative polarity.

3. The liquid crystal display device according to claim 2, wherein, the liquid crystal display device displays images with 256 gradations (G0 to G255), and the first DC bias voltage is set to a negative polarity for a range from a gradation value larger than G0 to near a halftone gradation value G127.

4. The liquid crystal display device according to claim 1, wherein the driving unit sets the second DC bias voltage to 0 V.

5. The liquid crystal display device according to claim 4, wherein, the liquid crystal display device displays images with 256 gradations (G0 to G255), and the second DC bias voltage is set to 0 volt for a range from near a halftone gradation value G63 to near a halftone gradation value G127.

6. The liquid crystal display device according to claim 1, wherein the driving unit sets the second DC bias voltage to a polarity opposite to the polarity of the first DC bias voltage.

7. The liquid crystal display device according to claim 6, wherein, the liquid crystal display device displays images with 256 gradations (G0 to G255), and the second DC bias voltage is set to a positive polarity for a range from gradation value larger than G0 to near a halftone gradation value G95.

8. The liquid crystal display device according to claims 1, wherein the first color pixel is a green color pixel.

9. The liquid crystal display device according to claim 8, wherein the second color pixel is a red color pixel or a blue color pixel.

10. The liquid crystal display device according to claim 1, wherein the driving unit superimposes a third DC bias voltage having a positive polarity on voltages applied to the first and second pixel electrodes in a white display state in which a potential difference occurs between the first pixel electrode and the common electrode and between the second pixel electrode and the common electrode, the third DC bias voltage being higher than a superimposed voltage for a black display state in which no potential difference occurs between the first pixel electrode and the common electrode and between the second pixel electrode and the common electrode.

11. A method of driving a liquid crystal display device including:

a first substrate including a first switching element arranged in a first color pixel and a second switching element arranged in a second color pixel of which color is different from the color of the first color pixel in an active area, a common electrode arranged in the first color pixel and the second color pixel, an insulating film arranged on the common electrode, first and second pixel electrodes arranged on the insulating film in the first and second color pixels and electrically connected with the first and second switching elements, respectively, and a first alignment film covering the first pixel electrode and the second pixel electrode;

a second substrate including a second alignment film facing the first alignment film; and a liquid crystal layer held between the first alignment film and the second alignment film; the method driving the liquid crystal display device comprising the steps:

when superimposing DC bias voltages on voltages corresponding to gradations to be displayed in the first color pixel and the second color pixel, respectively, and to supply the superimposed voltages to the first pixel electrode and the second pixel electrode, supplying a first halftone gradation voltage obtained by superimposing a first DC bias voltage on a voltage corresponding to a halftone gradation to be displayed to the first pixel electrode;

supplying a second halftone gradation voltage obtained by superimposing a second DC bias different from the first DC bias voltage on a voltage corresponding to a halftone gradation to be displayed to the second pixel electrode, and wherein the first and second half tone gradation voltages supplied to the first and second pixel electrodes are respectively formed of asymmetric rectangular wave voltages with respect to positive and negative polarities.

12. The method of driving a liquid crystal display device according to claim 11, wherein the first DC bias voltage has a negative polarity.

13. The method of driving a liquid crystal display device according to claim 11, wherein the driving unit sets the second DC bias voltage to a polarity opposite to the polarity of the first DC bias voltage.

14. A liquid crystal display device, comprising:

a first substrate including a first switching element arranged in a green color pixel, a second switching element arranged in a red color pixel and a third switching element arranged in a blue color pixel in an active area, a common electrode arranged in the green, red and blue color pixels, an insulating film arranged on the common electrode, a first color pixel electrode, a second color pixel electrode and a third pixel electrode arranged on the insulating film in the green, red and blue color pixels and electrically connected with the first, second and third switching elements, respectively, and a first alignment film covering the first, second and third pixel electrodes;

a second substrate including a second alignment film facing the first alignment film;

a liquid crystal layer held between the first alignment film and the second alignment film; and a driving unit to superimpose DC bias voltages on voltages corresponding to gradations to be displayed in the green, red and blue color pixels, and to supply the superimposed voltages to the first, second and third color pixel electrodes, respectively; wherein a first halftone gradation voltage of negative polarity obtained by superimposing a first DC bias voltage on a voltage corresponding to a halftone gradation to be displayed is supplied to the first color pixel electrode, a second halftone gradation voltage obtained by superimposing a second DC bias voltage different from the first DC bias voltage on a voltage corresponding to a halftone gradation to be displayed is supplied to the second and third color pixel electrodes, and the first and second half tone gradation voltages supplied to the first, second and third color pixel electrodes are respectively formed of asymmetric rectangular wave voltages with respect to positive and negative polarities.

15. The liquid crystal display device according to claim 14, wherein, the liquid crystal display device displays images with 256 gradations (G0 to G255), and the first DC bias voltage is set to a negative polarity for a range from gradation value larger than G0 to near a halftone gradation value G127.

16. The liquid crystal display device according to claim 14, wherein the driving unit sets the second DC bias voltage to a polarity opposite to the polarity of the first DC bias voltage.

17. The liquid crystal display device according to claim 16, wherein the liquid crystal display device displays images with 256 gradations (G0 to G255), and the second DC bias voltage is set to the positive polarity for a range from gradation value larger than G0 to near a halftone gradation value G95.

* * * * *